United States Patent [19]

Grether

[11] Patent Number: 5,048,258

[45] Date of Patent: Sep. 17, 1991

[54] WINDOW HAVING A TENSIONED INSULATION FOIL

[76] Inventor: Paul Grether, Begonienstr. 11-CH-8472, Seuzach, Switzerland

[21] Appl. No.: 414,116

[22] Filed: Sep. 28, 1989

[30] Foreign Application Priority Data

Jul. 26, 1989 [CH] Switzerland ..... 02786/89

[51] Int. Cl.[5] ..... E04C 2/54

[52] U.S. Cl. ..... 52/789; 52/790

[58] Field of Search ..... 52/789, 790, 788

[56] References Cited

U.S. PATENT DOCUMENTS 3,008,196 11/1961 Springer et al. ..... 52/790
4,334,398 6/1982 Grether ..... 52/789
4,432,174 2/1984 Grether et al. ..... 52/789
4,468,905 9/1984 Cribben ..... 52/789
4,520,611 6/1985 Shingu et al. ..... 52/789

FOREIGN PATENT DOCUMENTS 0867627 9/1978 Belgium .

*Primary Examiner*—Michael Safavi
*Attorney, Agent, or Firm*—Kenyon & Kenyon

[57] ABSTRACT

The insulated window is constructed with a pair of biaxially stretched foils which are secured on mounting elements at the edges. The mounting elements are in turn mounted on spring tension elements which serve to maintain the tension in the foils. Each spring element is connected to a common web which bears on a respective pane.

17 Claims, 4 Drawing Sheets

WINDOW HAVING A TENSIONED INSULATION FOIL

This invention relates to a window. More particularly, this invention relates to a compound insulated window having at least one insulation foil between two panes.

As is known, various types of insulated windows have been constructed. For example, Swiss Patent 653,404 a window formed of two transparent panes with a biaxially stretched insulation foil between the two panes. In this construction, the foil is spread out over a frame which, in an untensioned state, is curved on each side along a curve of unilaterally constant curvature, for example along the bending line of a uniformly loaded support which is not clamped. In order to stretch the foil, each side of the frame is deformed into a straight line. However, in order to be able to spread open a foil without folds, a high machining accuracy is required in the production of the curved frame sides. Because of this, the manufacture of the known windows requires a high manufacturing cost.

Accordingly, it is an object of the invention to reduce the manufacturing cost of an insulated window.

It is another object of the invention to simplify the tensioning system for a biaxially stretched foil in a compound window.

It is another object of the invention to simplify the mounting of a biaxially stretched foil within a compound window.

Briefly, the invention provides a window which is comprised of a pair of transparent panes and at least one biaxially stretched insulation foil disposed in a plane between the panes. In addition, a plurality of mounting elements are provided on at least one side of the foil with each of the elements having an adhesion point secured to the foil in offset relation to the plane of the foil. Still further, tension spring elements are disposed on each side of the foil to mount and to bias the mounting elements in a direction parallel to the panes. In this respect, the tension spring elements are secured to the window panes in order to pass the tensioning forces into the panes.

Each tension spring element may be constructed in the manner of a leaf-type spring of spring band steel and is positioned to bear against a panes. Where formed as a leaf type spring, the tensioning force of a spring element may be changed by variations in the thickness and/or web widths.

Further, in order to facilitate manufacture, several of the mounting elements may be combined into a band and/or if several spring elements are combined into a strip, the bands of the mounting elements may be slid along the spring element strips and may be provided with notches between the singular adhesion points in an alternating manner on both edges, for example as described in Swiss Patent 653,404.

These and other objects and advantages of the invention will become more apparent from the following detailed description taken in conjunction with the accompanying drawings wherein.

Figure 2:
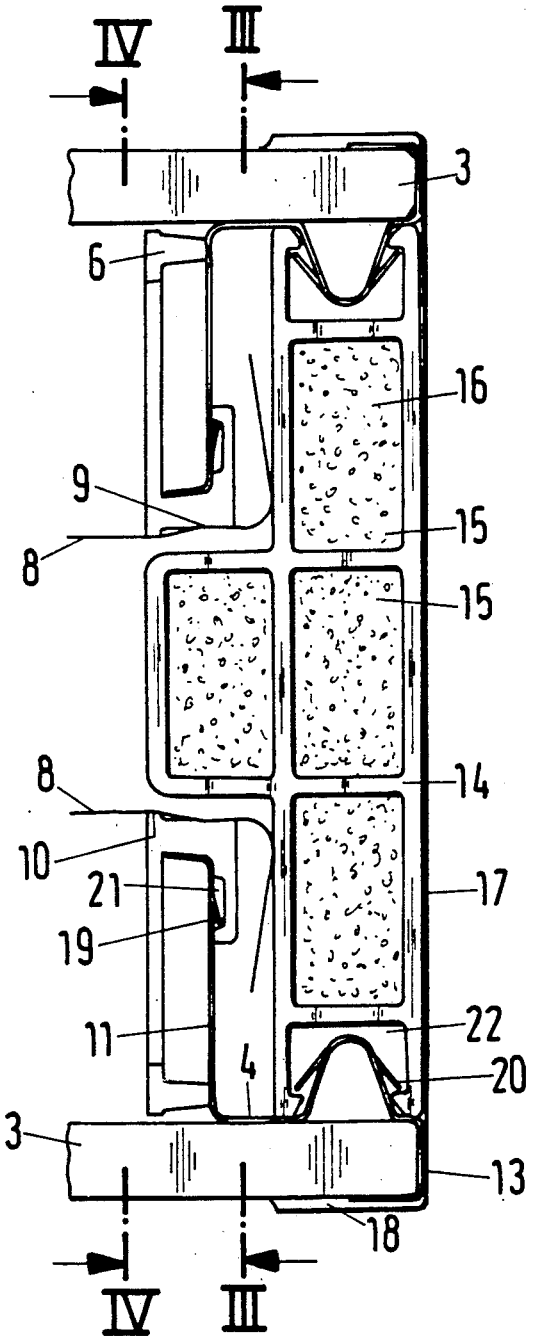
FIG. 2 illustrates a cross sectional view of one vertical side of a window constructed in accordance with the invention.
Figure 3:
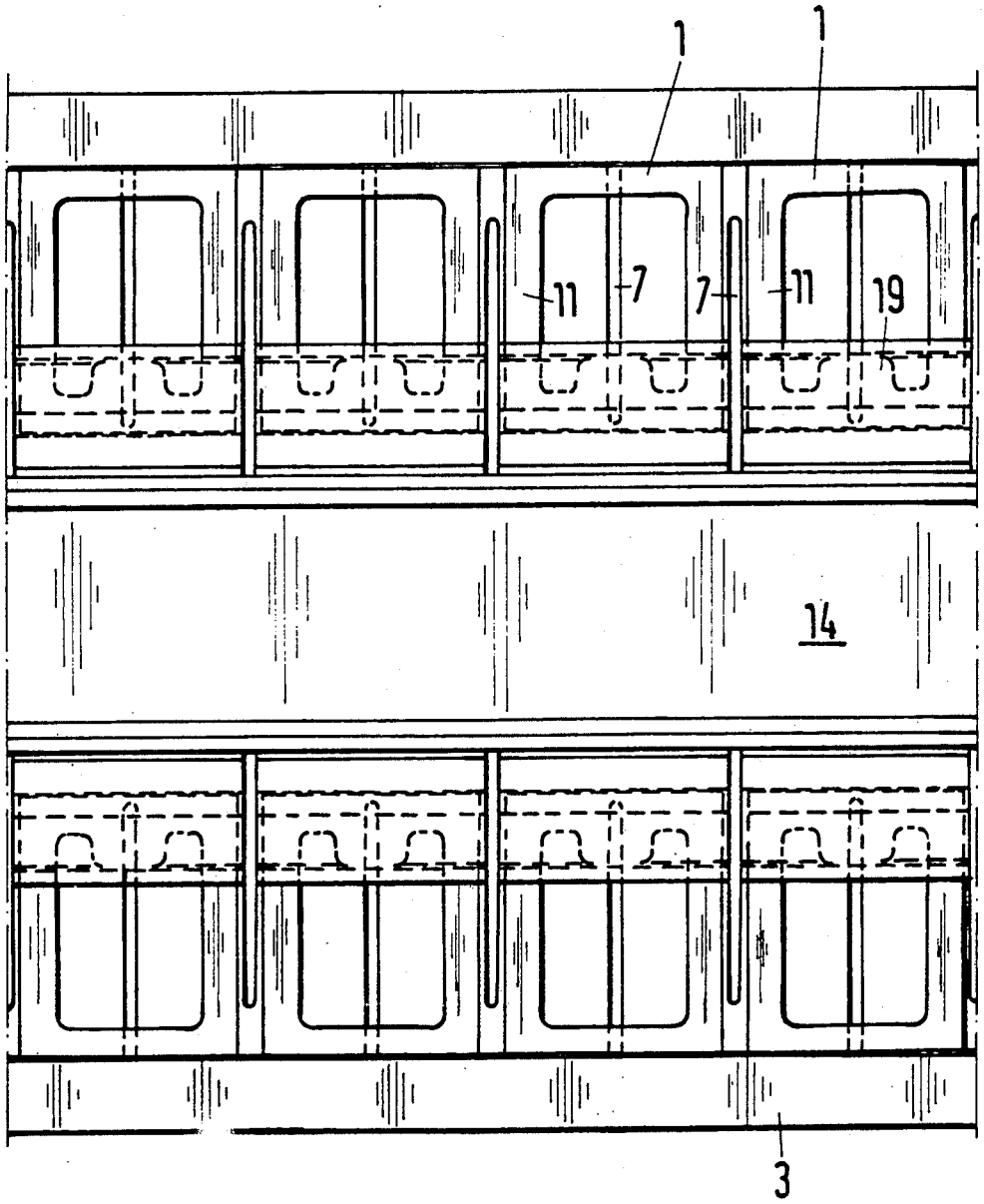
FIG. 3 illustrates a view taken on line III—III of FIG. 2.

Referring to FIG. 2, the insulated window is constructed of a pair of transparent panes 3, for example of rectangular shape with a pair of biaxially stretched insulation foils 8 for example, made of polyethylene terephthalate, disposed in parallel between the window panes 3. In addition, a spacer 14 is disposed peripherally about and between the window panes 3 to close off the space therebetween. The spacer 14 may be made of plastic and contains several chambers 15 which may be filled with a drying agent 16.

Figure 4:
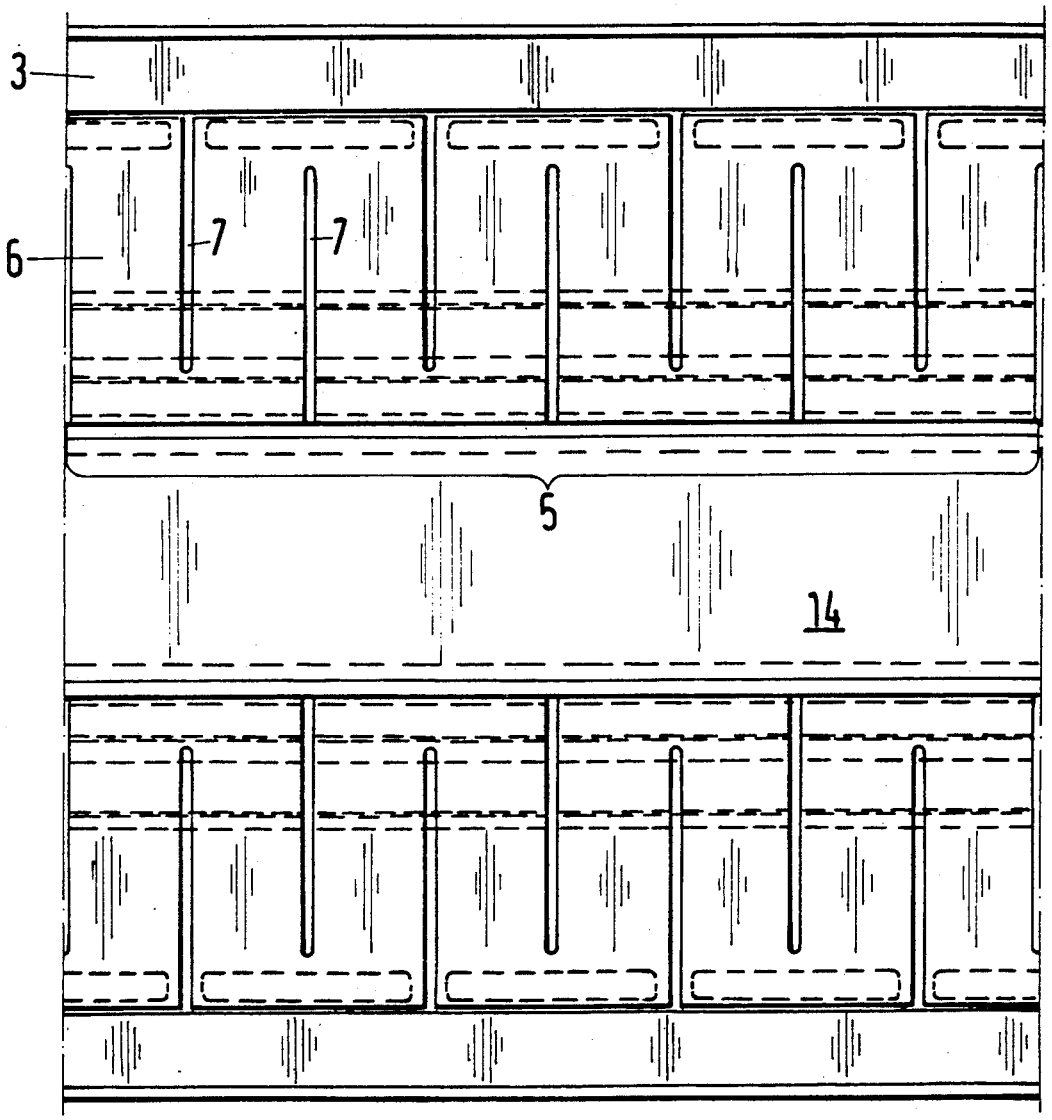
FIG. 4 illustrates a view taken on line IV—IV of FIG. 2.

In order to mount the foils 8 in place, a plurality of mounting elements 6 are disposed along each side of each foil 8 and each is slidably mounted on one of a plurality of tension-spring elements 1 on each side of the foil 8. In order to facilitate assembly, the spring elements 1 may be integrally formed into strips while the mounting elements 6 are integrally formed in bands 5. For example, referring to FIG. 1, three spring elements 1 which are made of spring band steel are secured to a common continuous web 4 while a band 5 having two mounting elements 6 of plastic is slidably mounted on two of the tension spring elements 1. As indicated in FIG. 4, the band 5 is provided with notches 7 which are disposed in alternating edges so as to permit longitudinal movement of the mounting elements 6. In this respect, each section of the band 5 which is disposed between two notches 7 on the same edge constitutes a sliding mounting element 6 which is mounted on a respective tension spring element 1.

Referring to FIG. 2, each mounting element 6 has a adhesion point 9 to which a transparent foil 8 is secured. In order to achieve a smooth biaxially tensioning of the foil 8, the adhesion points 9 are offset relative to the plane of the foil 8 so that the foil 8 is pulled over a bead type edge 10 of a mounting element 6.

Figure 1:
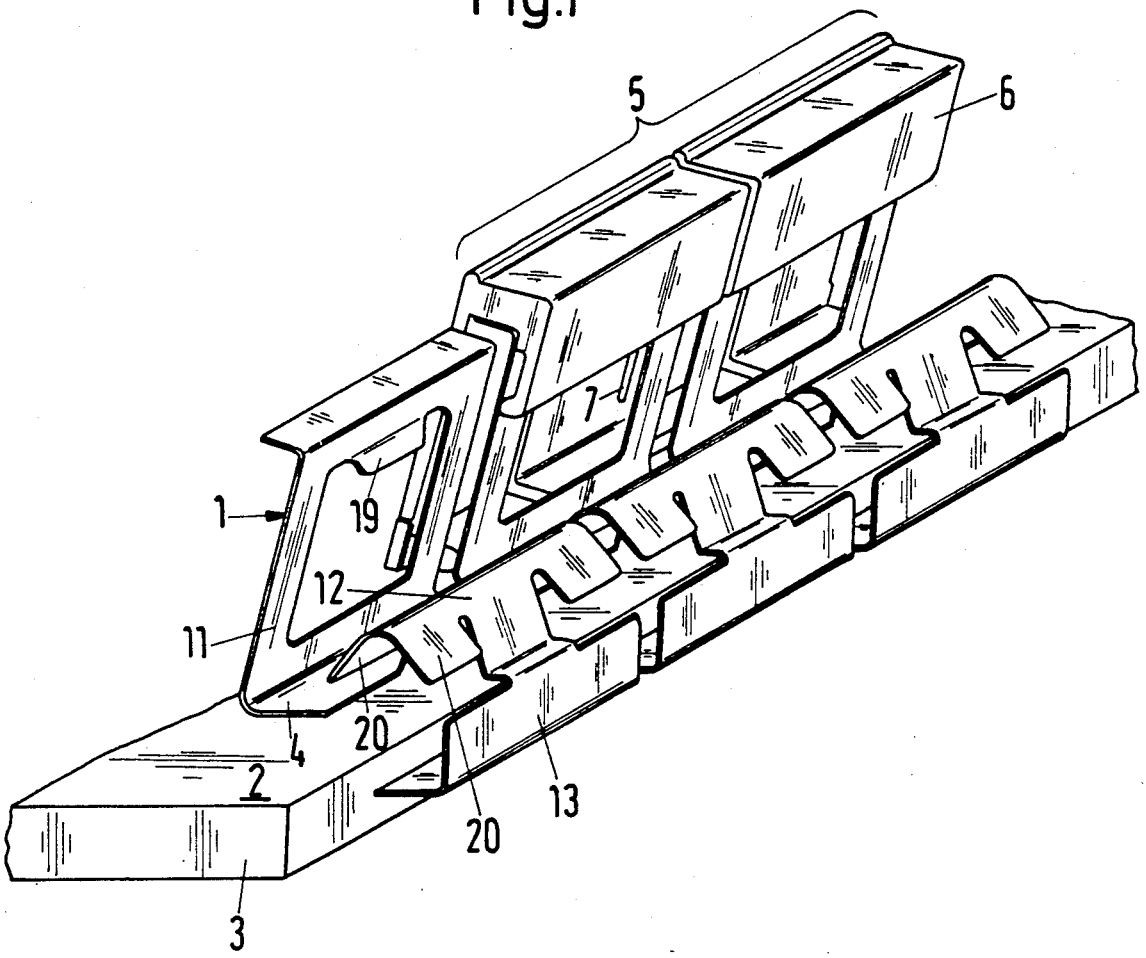
FIG. 1 illustrates a perspective view of the tension elements and mounting elements for securing a foil to a transparent window pane in accordance with the invention.

Referring to FIG. 1, each spring element 1 has a frame type member 11 extending almost perpendicularly from the continuous web 4 and has a bent free end at almost a right angle to serve as a bearing surface for a mounting element 6. Besides the material from which a spring element 1 is made and the thickness of the spring element 1, a variation of the widths of the vertical sides of the frame 11 can be used to alter the spring force of an element 1 within certain limits.

Referring to FIGS. 1 and 2, the continuous Web 4 serves as a bearing surface on a face of a pane 3 and is connected to a roof ridge type intermediate piece 12 which connects to an angle section 13.

The roof-ridge type intermediate piece 12 is sized to project into a longitudinal cavity 22 of the spacer 14 and serves a bearing surface for the spacer 14. The intermediate piece 12 also has pairs of elastically deformable flaps 20 which are snap-fitted into the cavity 22 so as to rest against shoulders at the mouth of the cavity 22 in order to retain the spacer 14 thereon.

The angle section 13 forms a mounting for the spring elements 1 against a window pane 3, possibly after the application of an intermediate layer (not shown) for example of foam material, which compensates for different pane thicknesses. As indicated in FIG. 2, the angle section 13 serves to engage about the window pane 3 so as to bias the web 4 against the window pane 3.

Referring to FIG. 2, a foil 17 encloses the compound window externally in order to form a vapor proof seal of the window. The foil 17 may be made of a stainless steel of about 0.1 millimeter thickness and may be secured to the panes 3 by means of an elastic bond 18, for example of polyurethane.

Referring to FIGS. 1 and 2, each tension element frame type member 11 is provided with an elastically deformable flap 19 which is disposed to engage in a corresponding cavity 21 in a mounting element 6.

The tensioning of a foil 8 occurs by means of a special tensioning device in which tension is first created in one direction and, under tension, the adhesion points 9 are "set" before the tensioning device is released. This sequence is then repeated in the direction of the other tensioning axis. The counter force to the tension in the foil is supplied by the elastic spring force of the spring elements 1, in particular in the transition between the continuous web 4 and the frame type members 11. Hence, the elasticity of the tensioning system is determined not by the material elasticity of the foil material but by the spring elasticity of the spring elements 1.

The displaceability of the mounting elements 6 relative to the panes 3 for compensation of different thermal expansions is ensured by the stretchability of the bands 5 and/or the possibility that the mounting elements 6 can slide on the spring elements 1.

In order to assemble the window, a band of mounting elements 6 is slid onto a strip of spring elements 1 with each mounting element 6 on a frame-type member 11. This unit is then slid into place over a edge of a window pane 3 as indicated in FIG. 1. In this condition, the frame type members 11 are inclined towards the intermediate piece 12. During tensioning, the frame type members 11 are bent away from the web 4, for example, in a counter-clockwise direction, as viewed in FIG. 2. During this time, the resistance to bending of the frame elements 11 serves to maintain the tension in the stretched foil 8.

After two panes 3 have been provided with a biaxially stretched foil 8, the two panes 3 are brought together and the spacer 14 inserted in place. In this respect, the cavities 22 of the spacer 14 are snapped over the intermediate pieces 12 connected to the continuous webs 4 of the spring elements 1. Next, the foil 17 can be put in place to seal the window.

The invention thus provides a window of insulated construction in which the tensioning system for a biaxially stretched foil is of relatively simple construction.

Further, the invention provides a tensioning system in which a foil can be stretched in a relatively simple low cost method.

The invention eliminates the need for a clamping frame with curved frame sides and the attendant precise machining of such curved frame sides.

What is claimed is:

1. A window comprising a pair of transparent panes;

at least one biaxially stretched insulation foil disposed in a plane between said panes;

a plurality of mounting elements on at least one side of said foil, at least one of said elements having an adhesion point secured to said foil in offset relation to said plane of said foil; and a tension spring element mounted on one of said panes and secured to said mounting elements in stretched relation therebetween said one pane and said mounting elements for biasing said mounting elements relative to said panes to maintain said foil in stretched condition.

2. A window as set forth in claim 1 wherein said spring element is a leaf-type spring of spring band steel.

3. A window comprising a pair of transparent panes;

at least one biaxially stretched insulation foil disposed in a plane between said panes;

a plurality of mounting elements one each side of said foil, each of said elements having an adhesion point secured to said foil in offset relation to said plane of said foil; and a plurality of spring elements mounted on one of said panes on each side of said foil and between said panes, said spring elements having said respective mounting elements mounted thereon for biasing said mounting elements relative to said panes.

4. A window as set forth in claim 3 wherein each spring element is a leaf-type spring of spring band steel having a web bearing on a respective pane.

5. A window as set forth in claim 3 wherein said mounting elements are displaceable along said spring elements in a direction parallel to a side of said window.

6. A window as set forth in claim 3 wherein at least some of said mounting elements are integrally connected to form a band with notches in alternating edges to permit longitudinal movement of said mounting elements thereof.

7. A window as set forth in claim 6 wherein at least some of said spring elements are integrally connected to form a strip.

8. A window as set forth in claim 3 wherein each spring element has an angle section for engaging about one of said panes.

9. A window as set forth in claim 3 which further comprises a spacer between said panes and along an edge thereof, said spacer having a longitudinal cavity therein and wherein at least one spring element has an intermediate piece fitted therein.

10. A window as set forth in claim 9 wherein said intermediate portion has a pair of elastically deformable flaps on opposite sides for engaging within said cavity of said spacer.

11. An insulated window comprising a pair of transparent panes;

a spacer disposed peripherally about and between said panes;

a pair of parallel biaxially stretched insulation foils between said panes;

a plurality of mounting elements on each side of each foil, each element having an adhesion point secured to a respective foil in offset relation to a plane of said respective foil; and a plurality of spring elements on each side of each foil having respective mounting elements thereon for biasing said mounting elements relative to said foils.

12. A window as set forth in claim 11 wherein said mounting elements are displaceable along said spring elements in a direction parallel to a side of said window.

13. A window as set forth in claim 11 wherein at least some of said spring elements are integrally connected to form a strip.

14. A window as set forth in claim 11 wherein each spring element has an angle section for engaging about one of said panes.

15. A window as set forth in claim 14 wherein said spacer has a longitudinal cavity along each edge of said panes and each spring element has an intermediate portion fitted therein.

16. A window as set forth in claim 15 wherein said intermediate portion has a pair of elastically deformable flaps on opposite sides for engaging within said cavity of said spacer.

17. A window as set forth in claim 11 wherein each spring element is a leaf-type spring of spring band steel having a web bearing on a respective pane.

* * * * *